US005613628A

United States Patent [19]

Burkhalter

[11] Patent Number: 5,613,628

[45] Date of Patent: Mar. 25, 1997

[54] GARMENT HANGER DEVICE

[76] Inventor: John C. Burkhalter, 823 Summerbrooke Dr., Tallahassee, Fla. 32312

[21] Appl. No.: 574,939

[22] Filed: Dec. 19, 1995

[51] Int. Cl.[6] ..... A47G 25/14; A47G 25/18; A47G 25/74

[52] U.S. Cl. ..... 223/85; 223/88; 223/92; 223/83; 223/89

[58] Field of Search ..... 223/85, 88, 89, 223/92, 94, 95, 37, 66, 81, 82; D6/315; 211/113

[56] References Cited

U.S. PATENT DOCUMENTS

| | | | |
|---|---|---|---|
| 952,202 | 3/1910 | Klingenfeld | 223/37 |
| 1,258,476 | 3/1918 | Severance | 223/37 |
| 1,741,750 | 12/1929 | Wordingham | 223/92 |
| 1,839,605 | 1/1932 | Siemen et al. | 223/92 |
| 2,151,502 | 3/1939 | Donnellan | 223/92 |
| 2,761,599 | 9/1956 | Lancaster | 223/92 |
| 2,796,206 | 6/1957 | Schwartz | 223/92 |
| 4,669,642 | 6/1987 | Nicholas | 223/94 |
| 4,921,098 | 5/1990 | Combier et al. | 223/92 |
| 5,038,979 | 8/1991 | Traylor | 223/85 |

FOREIGN PATENT DOCUMENTS

| | | | |
|---|---|---|---|
| 472570 | 7/1946 | Canada | 223/88 |
| 4306355 | 8/1994 | Germany | 223/92 |

*Primary Examiner*—Bibhu Mohanty
*Attorney, Agent, or Firm*—Carnes, Cona and Dixon

[57] ABSTRACT

The present invention provides a hanger device that is adapted to maintain a garment in a fixed and wrinkled free position. The hanger of the present invention comprises a hook that is secured to a pair of shoulder supports. The shoulder supports extend outwardly in opposite direction from the hook. A supportive sleeve extender extends from the shoulder support. These sleeve extenders are displaced from the shoulder support and extend inwardly and back towards each other, providing a gap to be located between the sleeve extenders and shoulder supports rendering the sleeve extenders and shoulder supports to be on different planes. A second gap is also located between the ends of the sleeve extender. This will enable a user to secure a garment for the upper body on the device in a worn position so that the back of the garment contacts the sleeve extenders. Once secured, the user tilts the hanger forward and inserts their hand between the sleeve extenders and the shoulder support, one side at a time. This will force the sleeve and a portion of the shoulder to be guided onto the sleeve extender and provide for the garment to be in a folded position. The hanger device also includes internal and external extensions extension which are adapted to maintain garments for the lower body and/or provide taut positioning of the upper body garment.

20 Claims, 6 Drawing Sheets

GARMENT HANGER DEVICE

BACKGROUND OF THE INVENTION

1. Field of the Invention

The present invention relates generally to a garment hanger device and more particularly to a garment hanger device which will adequately maintain a garment meant for the upper body such as shirts, blouses, sweaters, jackets, or the like, as well as garments meant for the lower body, such as pants, skirts or the like, in a folded or semi-folded, and wrinkle free environment.

2. Description of the Prior Art

Hangers are widely used for the storage of garments meant for the upper body. Typically, hangers consists of a hook portion, adapted to engage a closet bar or the like, and a triangular shape lower portion which is designed to receive the shoulders of the garment. Though this traditional hanger can maintain standard clothing, this hanger does not provide support for the body of the garment nor the sleeves. The flaw in this arrangement will enable the body and sleeves to dangle downwardly. The garment may sag and cause the body and sleeves to become wrinkled and lose its shape while hung. Accordingly, efforts have been made to provide for an adequate hanger device which will efficiently hang a garment or the like in a hung and stored position while still rendering the garment to maintain its original shape.

Such a device is disclosed in U.S. Pat. No. 4,669,642 issued to Nicholas. Nicholas discloses a hanger that is capable of being folded and reusable. This hanger disclosed in Nicholas includes a shirt body frame that is generally rectangular in shape. A pair of wings are hingedly secured to the outer ends of the shirt body frame while a tail panel is pivotally secured to a lower end of the shirt body frame. Though this hanger does provide a means of folding the shirt while in a hung position, this hanger fails to provide a means of effectively extending the suspension area while hung to prevent sagging and wrinkling, or of maintaining the sleeves in a fixed and folded position once the wings are tucked over. This design and configuration also fails to provide an overall taut positioning of the garments, thus allowing for many wrinkled areas. Additionally, the use of the hinged portion provides an opportunity for the clothing to get caught and tear, inherently ruining the garment.

As such, none of these previous efforts provide the benefits intended with the present invention, such as providing the garment to be hung in a fixed and wrinkle free position. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a hanger device that is adapted to maintain a garment in a fixed and wrinkled free position. The hanger of the present invention can be hung or optionally, includes a hook that can be pivoted downwardly for enabling the garment to be stored in a folded position.

The hanger of the present invention comprises a hook that is secured to a pair of shoulder supports. The shoulder supports extend outwardly in opposite direction from the hook. A supportive sleeve extender extends from the shoulder support. These sleeve extenders are displaced from the shoulder support and extend inwardly and also curves back towards each other, providing a gap to be located between the sleeve extenders and shoulder supports rendering the sleeve extenders and shoulder supports to be on different planes.

In order to use the above describe hanger, the user would hang the garment for the upper body on the device in a worn position so that the hanger is contained within the garment in the traditional manner and the back of the garment contacts the sleeve extenders. Once secured, however, the user tilts the hanger forward and from the back of the garment inserts their hand between the sleeve extenders and the shoulder support, one side at a time. This will force the sleeve and a portion of the shoulder to be guided onto the sleeve extender in a rearward manner and provide for the garment to be in a folded position.

The hanger device of the present invention can include a lower garment bar extension that is adapted to receive and maintain garments for the lower body. This lower garment bar extension is generally U-shaped and includes opposite ends which are pivotally secured to either the shoulder supports or below the hook area. This will enable the lower garment bar extension to pivot forward and away from the sleeve extenders so as to not interfere with the hands of the user or sleeves when the sleeves are being secured onto the sleeve extenders.

Optionally, the lower garment bar extension can be of a double jointed design so that it folds back upon itself for a more compact fold and may be removably secured to the hanger so as to provide internal support not only for the garment of the lower body, but also for the shirt itself.

For a more defined fold, the hanger can include a swivel rod which extends downwardly from each sleeve extender. Each rod is adapted to slide and/or swivel freely on the sleeve extender. An external body insert is adapted to be removably secured to the ends of the shoulder supports to provide external body support and may also be adapted to function as an external lower garment bar.

In order to utilize the above described hanger device of the present invention, the garment is placed on the shoulder support in a worn position. The user's hand is then slid between each shoulder support and sleeve extender for enabling the sleeves to slide onto the sleeve extender and be in a rearward folded position. The external body insert may then be inserted between the shoulder support and the sleeve extenders for even further bodice support for travel or packing. The rods are then slid towards each other until the rods contact the inseam of the garment. A securing means is attached to the rod for rendering the rods to be in a fixed and secured position. Optionally, the body insert may also be of a double jointed design so that it folds back upon itself for an even more compact fold. This will provide for the garment to be hung or laid in a folded position for either storage, display or transport.

The hanger device can also include a collar support which is adapted to maintain a collar of a shirt, sweater, or the like in a formed and non distorted position, so as to provide support for the collar area of a garment which is not in use. This collar support can also be utilized for supporting accessories, such as ties and the like.

Accordingly, it is the object of the present invention to provide for a hanger device that will overcome the drawbacks, disadvantages, and shortcomings of prior hanger devices and method thereof.

It is yet another object of the present invention to provide a hanger device which will adequately and efficiently maintain a garment in a fixed and folded position, rendering a garment that is wrinkle free during storage, display, or transport.

Still another object of the present invention is to provide for a hanger device which is versatile and which will enable a user the option of hanging and storing garments for the upper body and lower body singularly or in combination thereof.

Still a further object of the present invention, to be specifically enumerated herein, is to provide a hanger device in accordance with the preceding objects and which will conform to conventional forms of manufacture, be of simple construction and easy to use so as to provide a device that would be economically feasible, long lasting and relatively trouble free in operation.

Although there have been inventions related to hanger devices, none of the inventions have become sufficiently compact, low cost, functional and reliable enough to become commonly used. The present invention meets the requirements of functionality, simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings

BRIEF DESCRIPTION OF THE DRAWINGS

FIG. 6*a* illustrates the initial internal arrangement of the device within the upper body garment with optional rods shown. FIG. 6*b* illustrates positioning the upper body garment after hand insertion has forced the sleeves and a portion of the shoulders onto the sleeve extenders with optional rods shown. FIG. 6*c* illustrates the top insertion of the external body insert between the separate planes of the shoulder support and the sleeve extenders as described in the fourth embodiment of the present invention. FIG. 6*d* illustrate the internal rods slid fully towards each other contacting the inseam of the garment and held together by an external securing means.

Similar reference numerals refer to similar parts throughout the several views of the drawings.

DESCRIPTION OF THE PREFERRED EMBODIMENTS

Figure 1A:
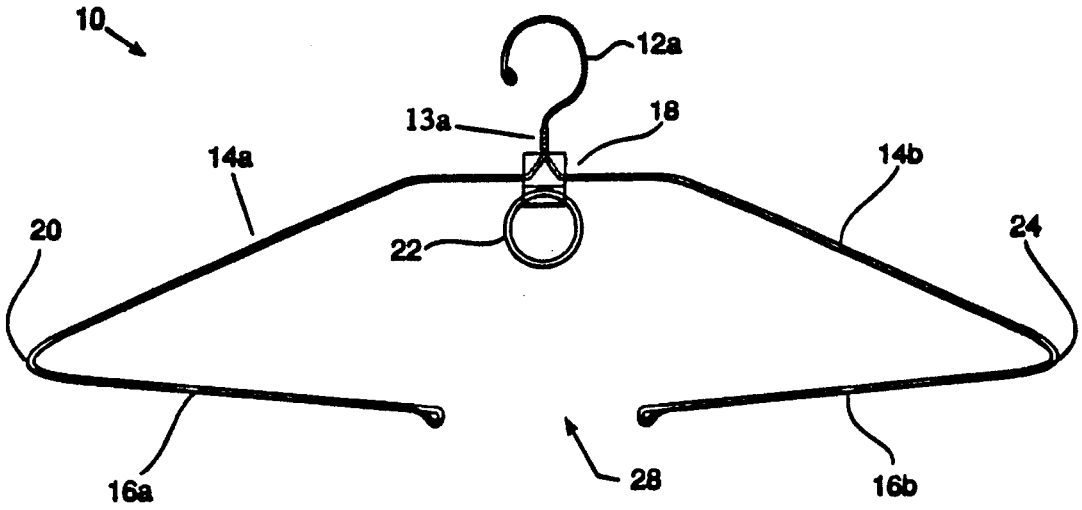
FIG. 1*a* is a front plan view of the first embodiment of the hanger device of the present invention with optional double sided clip and loop shown below the hook.
Figure 1B:
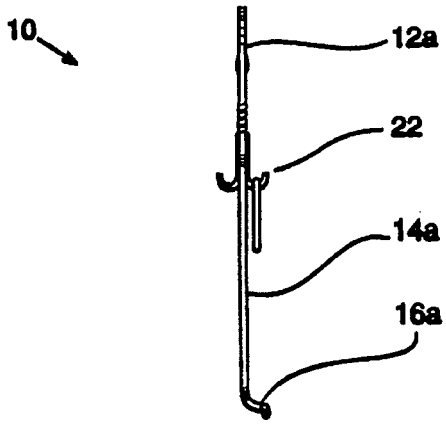
FIG. 1*b* is a side plan view of the first embodiment of the hanger device of the present invention with optional double sided clip and loop shown below the hook.
Figure 1C:
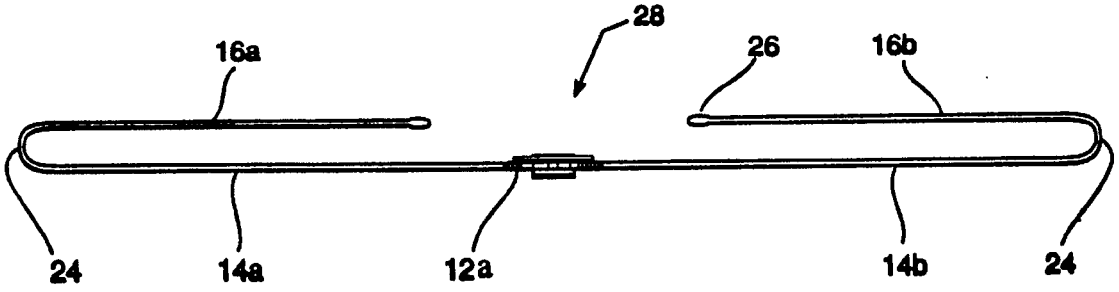
FIG. 1*c* is a top view of the first embodiment of the hanger device of the present invention.

FIGS. 1*a*–1*c* illustrate the first embodiment of the hanger device 10 of the present invention. As seen, the hanger device 10 of the present invention includes a hook member 12*a*, a pair of shoulder supports 14*a* and 14*b*, and a sleeve extenders 16*a* and 16*b*. The hook member 12*a* is secured to the shoulder supports 14*a* and 14*b*. The sleeve extenders 16*a* and 16*b* extend downwardly and towards each other, and outwardly from the shoulder supports 14*a* and 14*b*. This will provide for the sleeve extenders to be displaced from the shoulder support on a separate plane.

The shoulder supports 14*a* and 14*b* each include a top end 18 and side end 20. The top end 18 is secured to the hook member 12*a* while the side ends 20 are secured to or connected with the sleeve extenders 16*a* and 16*b*. These shoulder supports 14*a* and 14*b* extend slightly downwardly and in opposite direction from the top end. This will provide for the shoulder support 14*a* and 14*b* to be inclined downward with respect to the horizontal in an approximation of the natural slope of the shoulders.

A double side clip including a loop 22 can be located under the hook member 12*a* and can be used for securing other hanger attachments and/or for hanging and maintaining accessories, such as ties, scarves, jewelry, or the like.

The sleeve extenders 16*a* and 16*b* are secured to the side end 20 of the shoulder support 14*a* and 14*b*, respectively. As seen in these figures, each sleeve extender includes a first end 24 and a second end 26. The first end 24 is secured to the shoulder support. These first ends 24 are designed and configured to have a U-shape (see FIG. 1*c*) and provide for the sleeve extenders to extend outwardly from the shoulder supports 14*a* and 14*b* rendering the sleeve extenders 16*a* and 16*b* to be displaced in a separate plane from the shoulder supports. This will provide for a first gap or space (illustrated in FIG. 1*c*, but not labeled) to exist between the sleeve extenders 16*a* and 16*b* and the shoulder supports 14*a* and 14*b*, respectively when viewed from the top plane. From the first end 24, the sleeve extenders 16*a*, 16*b* extend downwardly in opposite directions and toward each other. A second gap 28 is located between the second ends 26 of the sleeve extenders 16*a* and 16*b*. This second gap 28 is adapted to receive the hand of the user for enabling the sleeve of the garment to fit properly on the sleeve extender and be in a folded position.

In order to utilize the above described embodiment of the hanger device of the present invention, the user merely places a garment for the upper body on the hanger in a worn position. Accordingly, if a button shirt were placed on the hanger, then the shirt would be buttoned. The shirt is placed on the hanger such that the back of the shirt contacts the sleeve extenders 16*a* and 16*b* (see FIG. 6*a*). Once the upper body garment is secured to the hanger device 10, the device is tilted frontward, so that the sleeve extenders are approximately parallel and horizontally aligned with the hook member 12*a*. The user then places his hand between a sleeve extender 16*a* and shoulder support 14*a* via the first and second gap. This will force the sleeve and a portion of the shoulder of the garment onto the sleeve extender 16*a*. The hanger is rotated and the process is repeated for the opposite sleeve. This will provide for the shirt to be in a hung and folded position, providing approximately twice the support area as a conventional hanger of similar width (see FIG. 6*b*).

The above described embodiment can be altered to provide for garments for the lower body to be hung along with the garments for the upper body. This alteration provides for a lower garment bar extension to be located on the hanger device of the present invention. The alteration is illustrated in further detail in FIG. 2 and provides for a second embodiment for the hanger device 10 of the present invention. As seen in this figure, the hanger device 10 includes a hook member 12*b*, shoulder supports 14*a*, 14*b* and sleeve extenders 16*a* and 16*b*. The top ends of the shoulder support 14*a* and 14*b* are secured to the hook member 12*b* while the side ends are secured to or connected with the sleeve extenders 16*a* and 16*b*. The shoulder supports are configured to incline downward with respect to the horizontal in an approximation of the natural slope of the shoulders.

The sleeve extenders 16*a* and 16*b* are configured to extend outwardly from the shoulder supports, rendering the sleeve extenders to be displaced in a separate plane from the shoulder support. Accordingly, the shoulder support 14*a*, 14*b* and sleeve extenders 16*a*, 16*b* are identical in structure and design as the first embodiment.

The lower garment bar extension 30*a* is formed to maintain a garment for the lower body, such as pants, skirts or the like, in a folded or hung and wrinkle free position. As such, this lower garment bar extension 30*a* includes a sideward C-shape having distal ends 32. These distal ends 32 are pivotally secured to the shoulder support 14*a* and 14*b*. This will enable the user to freely pivot the hung lower garment away from the sleeve extenders 16*a* and 16*b* so as to allow the user to hang the garment for the upper body, such as a shirt. Such a pivotal attachment will permit an adequate amount of clearance to exist, so as to enable the user to hang the upper garment efficiently and without interference from the lower garment bar extension 30*a*.

It is noted that the distal ends of the lower garment bar extension can be secured along any point of the shoulder support. The distal ends can also be pivotally secured to the sleeve extenders.

The lower garment bar extension 30*a* further includes elbows 34 that are aligned with the curved second ends 26 of the sleeve extenders 16*a* and 16*b*, respectively. A lower portion 36 is secured to the elbow. This lower portion 36 is adapted to receive garments for the lower body, such as pants or the like. Clips 38 can be located on the lower portion for enabling skirts or the like to be hung.

This design and configuration of the hanger device 10 will enable garments for both the upper and lower body member to be hung efficiently.

Accordingly, in order to utilize this embodiment of the present invention, the user must first place the garment for the lower body (such as pants) on the lower garment bar extension 30*a*. Once secured, the upper body garment is placed on the shoulder supports 12*a* and 12*b* as discussed in the first embodiment. As such the first end of the sleeve extenders will be extending towards the back of the garment for the upper body. This will provide for the sleeve extenders 16*a* and 16*b* to be contacting the back surface of the upper body garment.

Holding the hanger device at a slight angle and facing the back of the garment will inherently provide for the lower garment bar extension 30*a* to be weight shifted or manually pivoted forward and downward, away from the sleeve extenders 16*a* and 16*b*. Once the lower garment bar extension 30*a* is pivoted away from the sleeve extenders, the user inserts their hand between the first shoulder support and first sleeve extender. This will provide for the sleeve of the garment and a portion of the shoulder of the garment to slide onto the sleeve extender 16*a* and be in a folded position, supported via the sleeve extender. This same process is repeated for the opposite side, thereby providing for the garments for both the upper and lower body to be hung in a folded and wrinkle free position. This configuration of the hanger device 10 of the present invention will provide for the lower garment bar extension 30*a* to be located inside the garment for the upper body. The use of the lower garment bar extension 30*a* will not only provide support for the garment for the lower body but will inherently provide support for the lower portion of the garment for the upper body.

The above described embodiment is not limited to solely one lower garment bar extension 30*a*. Alternatively, a plurality of lower garment bar extensions can be used. Accordingly, a double (as illustrated) or even a triple jointed lower garment bar may be used to support more than one lower garment and to fold to a more compact size for transport. This embodiment provides a hanger device which will not only add support for the upper body garment but will also successfully hang lower garments in a wrinkle free environment. As seen in this figure, there is illustrated a second lower garment bar extension 30*b* who's lower portion 36 is pivotally secured to the first lower garment bar extension 30*a* via distal ends 32. Clips 38 can be located on all the additional lower garment bar extensions for providing the garments for the lower body member (i.e. skirts) to be secured onto the hanger device.

The lower garment bar extensions used and described provide a device that includes a plurality of sub-units (i.e. 30*a* and 30*b*), which are adapted to maintain and secure garments for the lower body member. The lower garment bar extension is not limited to solely two sub-units, as illustrated, but can include any number of sub-units, to provide for a hanger device which can successfully maintain a plurality of garments for the lower body member. Hence, providing for each subsequent lower garment bar extension to be pivotally secured to each preceding lower garment bar extension.

Further still, the use of a second lower garment bar extension 30*b* will enable the user to fold it back upon itself for providing a more compact fold. This configuration is ideal when the hanger device is used to solely hang a garment for the upper body. Accordingly, once the garment for the upper body is hung on the device, the second lower garment bar extension 30*b* can be folded upward to contact the first lower garment bar extension 30, for providing the device to be in a compact folded position.

Though not illustrated, the double sided clip 22 can be located under the hook member 12*b*, as illustrated in FIG. 1*a*, for maintaining accessories, such as ties, belts or the like.

Figure 3:
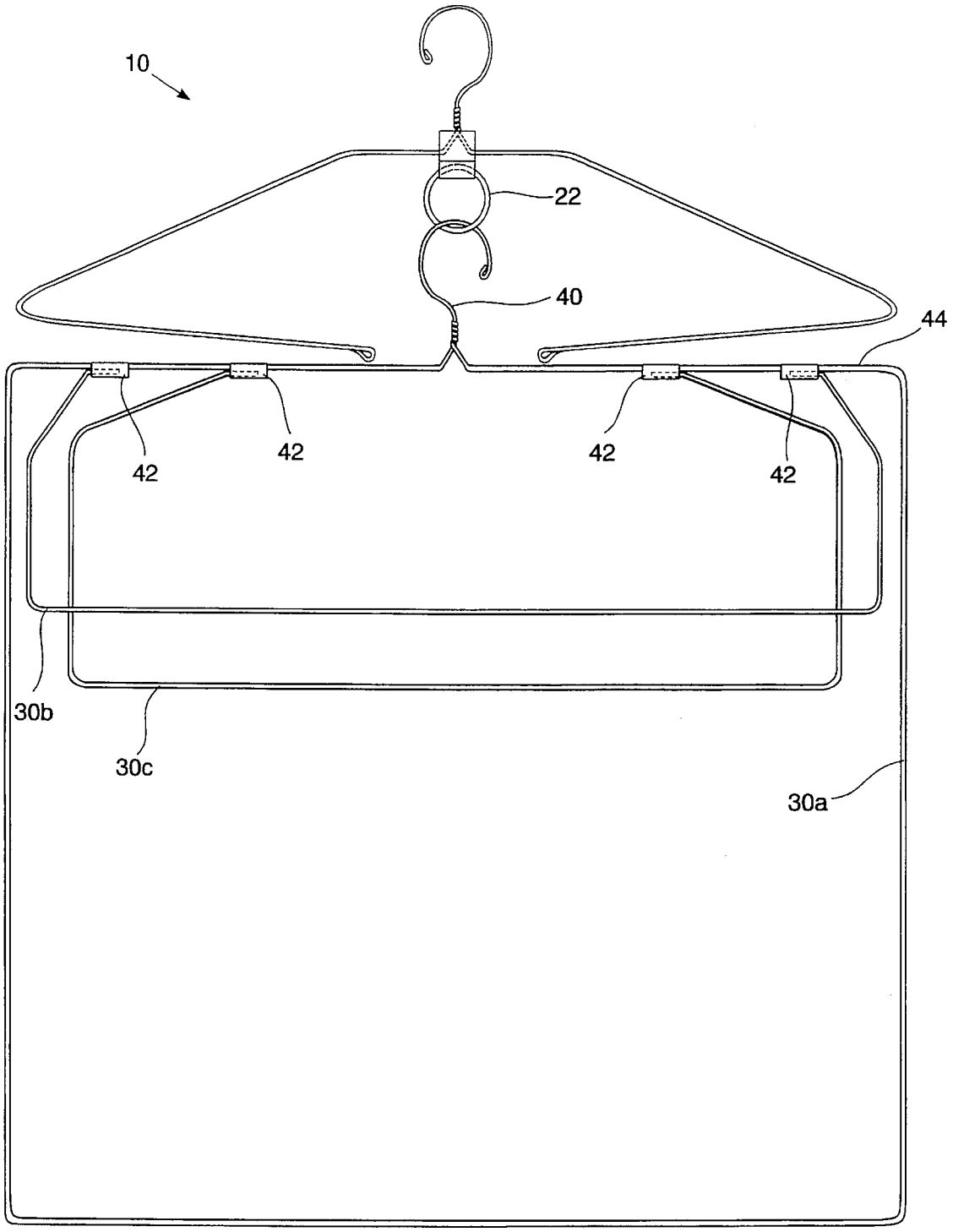
FIG. 3 is a front plan view of the third embodiment of the hanger device of the present invention.
Figure 4:
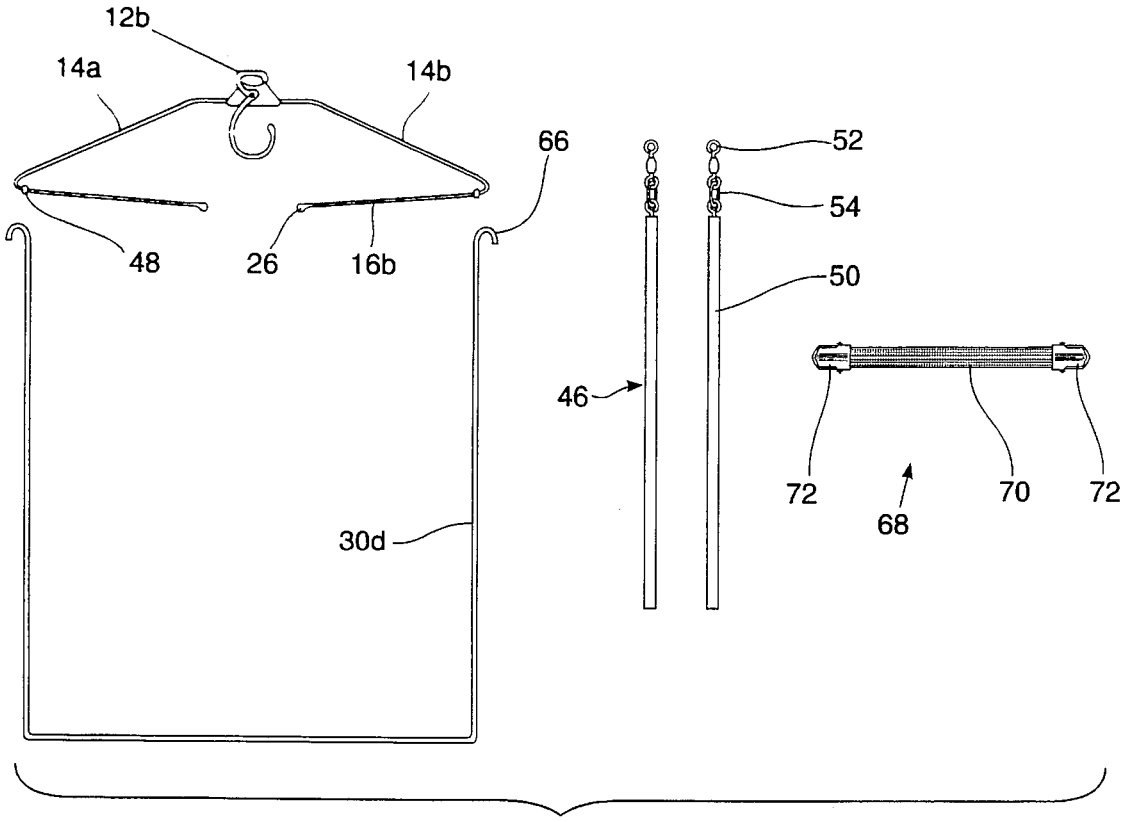
FIG. 4 is a front plan view of the fourth embodiment of the hanger device of the present invention.

Alternatively, the plurality of lower garment bar extensions can be pivotally mounted on the main or first lower garment bar extension 30*a*. This alteration is illustrated in further detail in FIG. 3. As seen in this figure, the main lower garment bar extension 30*a* includes a second hook member 40 which is adapted to be removably secured to the double sided clip 22 of the first embodiment (FIG. 1*a*). This will enable the lower garment bar to be adapted to be removably secured to the main hanger device 10 for garments for the upper body.

Figure 2:
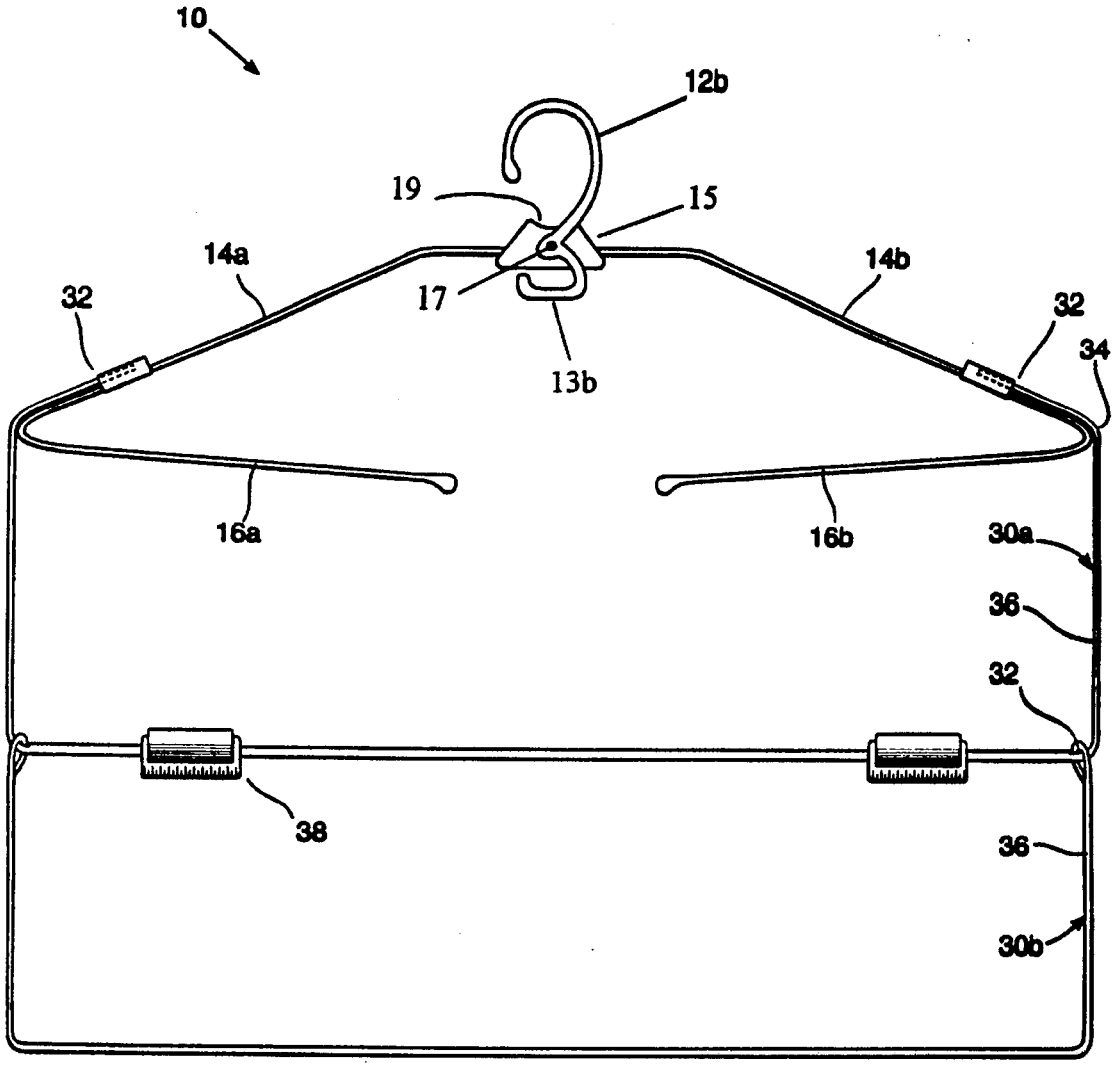
FIG. 2 is a front plan view of the second embodiment of the hanger device of the present invention.

As seen in this figure, the second hook member 40 is secured to the upper portion of the main lower garment bar extension 30*a*. The main lower garment bar extension 30*a* is typically of a rectangular or U-shaped and includes an upper portion 44 having a horizontal bar. As seen in this embodiment, the main lower garment bar extension 30*a* is adapted to extend downwardly and beyond the plurality of additional lower garment bar extensions (30*b* and 30*c*) These plurality of additional lower garment bar extensions 30*b* and 30*c*) are pivotally mounted on the upper portion 44 of the main lower garment bar extension 30*a*. This will provide for a plurality of sub-units (i.e. 30*b* and 30*c*) to be pivotally secured to the main lower garment bar extension 30*a*. Each additional lower garment bar extension may include clips for maintaining skirts (as illustrated in FIG. 2).

In order to utilize this embodiment, the user would first secure the garment(s) for the lower body onto the lower garment bar extension(s) and the extension(s) then are attached to the main upper body hanger via the second hook member 40 to the double sided clip 22. Once secured, the garment for the upper body is secured as previously described for the first and second embodiment of the present invention. This will provide for a compact hanger device which will not only hang garments for both the upper and lower body member, but will also provide rigidity and support for the lower portion of the shirt, blouse, or the like. This design and configuration will also provide for the lower body bar extension(s) to be internally located within the shirt once the device is secured to the hanger.

To provide even more rigidity, taut, and shape for the lower portion of the garment for the upper body, the hanger device 10 illustrated in FIG. 1*a* can include rods 46 that are secured to the sleeve extenders. This additional feature is illustrated in further detail in FIGS. 4 and 6*a*–6*d*. As seen in these figures, the rods 46 are adapted to be slidably and/or swivelably maintained on the sleeve extenders 16*a* and 16*b*, respectively. Accordingly, the second end 26 of the sleeve extenders are enlarged, curved or otherwise altered in order to provide a natural stop for the rods 46. Optionally, a second stop 48 can be located in the proximity of the first end 24 so as to prohibit the rods 46 to slide onto the curved second end 26 of the sleeve extenders 16*a* and 16*b*, respectively.

The rods 46 are designed so as to slide freely on sleeve extenders 16*a* and 16*b* so as to allow for placing tension on garments of various sizes. As such, each rod 46 comprises an elongated shaft 50 that is connected to an eyelet 52. This eyelet 52 will enable the rod 46 to slide freely on the sleeve extenders 12*a* and 12*b*. Optionally, and as illustrated, these rods 46 can also be adapted to swivel and rotate freely by way of a conventional swivel member 54 which is secured between the eyelet 52 and shaft 50.

To provide for the body of the garment to maintain a fixed position, an external body insert extension 30*d* is adapted to be slidably inserted between the sleeve extenders and the shoulder support once the garment is located on the device. This external body insert 30*d* can be similar in design as the lower garment bar extension illustrated in FIG. 3 so as to provide for a second hook member to be secured to the external body insert. This will enable the external body insert 30*d* to be removably secured to the lower portion of the first hook member 12*b*.

Optionally, and as illustrated, the external body insert 30*d* can include a pair of hooks 66, oppositely located at distal ends. This will provide for the external body insert 30*d* to be removably secured to the sleeve extenders 16*a* and 16*b* by enabling the hooks 66 on the external body insert 30*d* to be adapted to engage the curved side end 24 of the sleeve extenders. Accordingly, it is seen that this external body insert is designed to be removably secured to the sleeve extenders 16*a* and 16*b*.

The external body insert 30*d* can be a solid piece of material or a framework, having a rectangular shape, H-shape, U-shape or can include any of the configurations illustrated in the above described embodiments. A solid shape external body insert 30*d*, fabricated from card board would be ideal for dry cleaners, or the like, while the other framework shapes of the body insert would be ideal for hanging garments for more durability during travel and can even be constructed so as to hang garments for the lower body as well.

Figure 5:
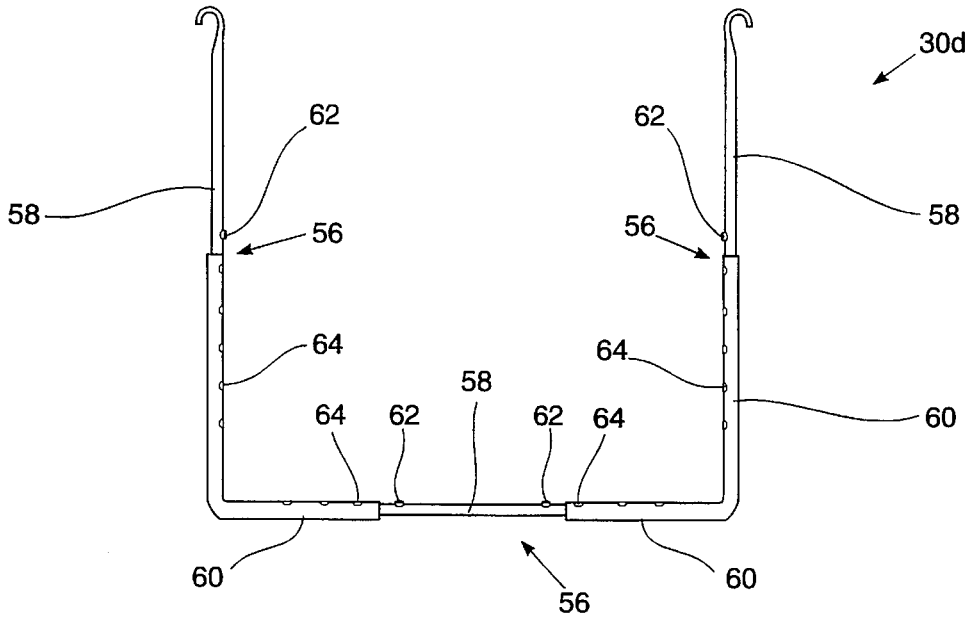
FIG. 5 is a front plan view of the external body insert used in the hanger device of the present invention including an adjusting means.

Optionally, the length and/or width of the external body insert can be altered. As seen in FIG. 5, the length and width of the body insert 30*d* can be adjusted via an adjusting means 56. This adjusting means 56 can be any conventional adjusting means, as illustrated, the adjusting means 56 includes a first section 58 that is adapted to be received within a second section 60. This will provide for the first section 58 to be adapted to slide freely within the second section 60. Located on the first section 58 is a spring loaded button 62, while located on the second section are a plurality of evenly spaced apertures 64. This design will enable the first section 58 to be received in the second section 60. The adjusting means 56 permits for a secure affixment of the first section 58 to the second section 60.

In order to adjust the length and/or width of the external body insert 30*d*, the button 62 would be pressed and the first section 58 would slide within the second section 60. The button 62 emerges at the first available aperture located on the second section, thus locking the external body insert 30*d* in a fixed position. If that length or width is not desired then the process is continued until the desired length is obtained.

A securing means 68 is used to maintain the rods 46 in a fixed position against the inseam of a shirt. This securing means includes a central portion 70 having opposite ends. Secured to the opposite ends is a clip device 72 which is used to clasped and secure the rods. Hence, once the rods are contacting the inseam of the shirt, a clip device 72 is secured to each rod.

It has been discovered that a central portion formed from an elastic or adjustable material has produced favorable results. For the clip device, it has been discovered that alligator or suspender clips have been used to produce favorable results.

Figure 6A:
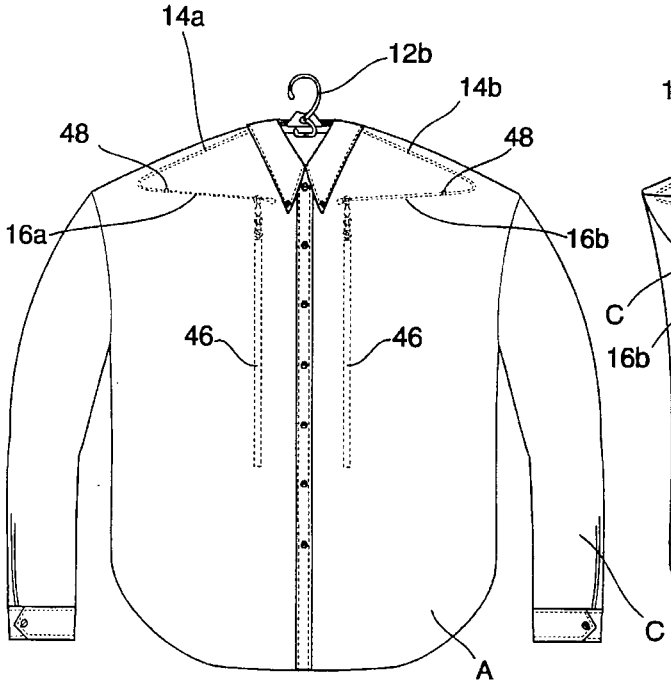
FIGS. 6*a*–6*d* illustrate the steps to use hanger device of the present invention.
Figure 6B:
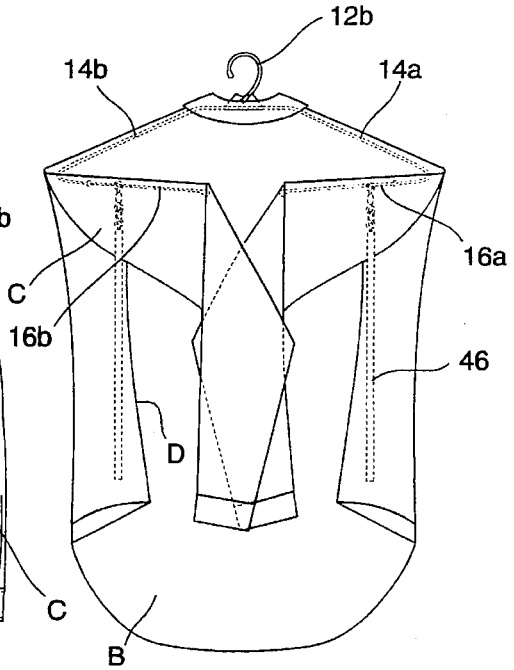

FIGS. 6*a*–6*d* illustrate the utilization of the hanger device 10 of the present invention. As seen in FIG. 6*a*, the garment A is placed on the hanger device 10 in a worn position. For example, if the garment is a shirt which includes buttons, then the shirt is completely buttoned. The first end of the sleeve extenders will be extending towards the back of the garment. This will provide for the sleeve extenders to be contacting the back surface B of the garment. Once on the hanger device, the rods 46 will be extending downwardly from the sleeve extenders.

Holding the hanger device 10 at a slight angle, and facing the back B of the garment C, the next step, is for the user to insert their hand between the first shoulder support 14*a* and first sleeve extender 16*a*. This will provide for the sleeve C of the garment A and a portion of the shoulder of the garment to slide onto the sleeve extender 16*a* and be in a rearward folded position, supported via the sleeve extender. This same process is repeated for the opposite side.

Figure 6C:
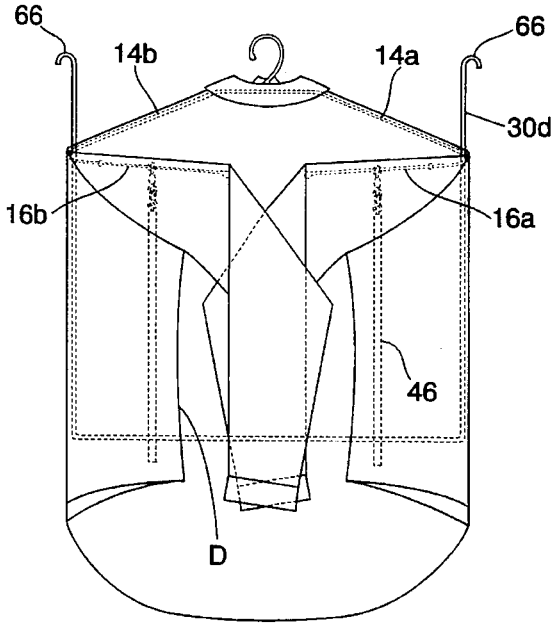

Once the sleeves are in a folded position on the sleeve extenders, the external body insert 30*d* is inserted between the sleeve extenders 14*a*, 14*b* and shoulder supports 16*a*, 16*b*, see FIG. 6*c*. The hook members 66 are secured to the device via the first curved end 24 of the sleeve extenders.

Figure 6D:
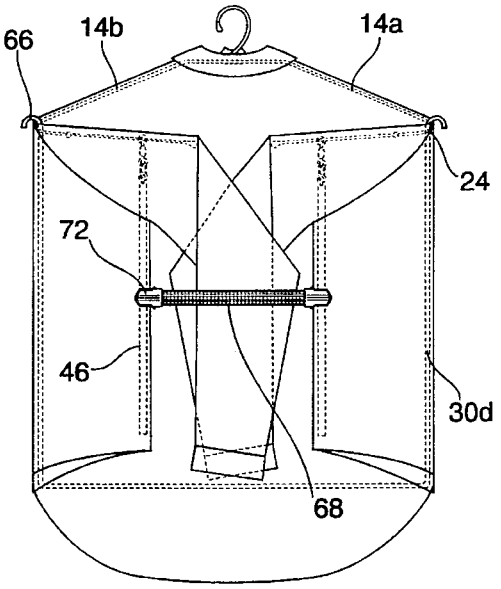

The rods 46 are slid towards each other until the rods contact the inseams D of the garment A (see FIG. 6*d*). The opposite ends 72 of the securing means 68 are then attached to each rod for providing the rods to be in a fixed position. The sleeves C of the garment may be inserted behind the securing means. Accordingly, the garment A is in a folded and wrinkle free environment.

Optionally, the external body insert can be designed as a double jointed or even a triple jointed structure. For this alteration, the external body insert would be structured similar to the internal lower garment bar illustrated in FIG. 2. The rods would extend downwardly towards the first sub-unit, but not pass the first sub-unit.

Further still, the rods can extend downwardly from each sub-unit so as to provide for each sub-unit to include the rods and a securing means for securing the rods in a fixed position.

As seen in various embodiments of the hanger device of the present invention, the hook members 12*a* and 12*b* can be affixed to the top end of the shoulder support members either permanently or pivotally. FIGS. 1*a*–1*c* illustrate various means of attaching the hook member 12*a* to the support members permanently. As seen in these figures, the hook member 12*a* comprises an unitary member having a top end including a hook portion and a lower member that is permanently secured to the top end of the shoulder support 14*a* and 14*b*, respectively.

As seen in FIGS. 1*a*–1*c*, this hook member 12*a* can be comprised of a piece of wire that is centrally folded. This folded wire is then bent to provide the top end with a hook portion. The lower member 13*a* is formed by twisting the folded wire alternatively and providing the support members 14*a* and 14*b* and sleeve extenders 16*a* and 16*b* to be formed from the folded wire and be an integral structure.

FIGS. 2, 4, and 6*a*–6*d* illustrate the hook member 12*b* being pivotally secured to the shoulder supports. As seen in this embodiment and shown in the various figures, the hook member 12*b* includes an upper member having a first hook portion and a lower member 13*b* having a second hook portion having a size smaller than the first hook portion. This hook member 12*b* is pivotally secured to a brace member 15 via a pin, rivet, screw or the like 17. This brace member 15 is secured to the top ends of the shoulder support 14*a* and 14*b*. This design and configuration will enable the first hook portion to be hung on a conventional closet rod, while the second hook portion is ideal for use with a conventional garment bag or suitcase device, or simply to reduce the vertical height for packing in a travel bag. A groove 19 can be located within the brace member for providing the hook member 12*b* to be secured to the standard rod located in a conventional garment bag and be in a locked position within the garment bag.

The hook member, discussed and illustrated in the above described embodiments are not limited to solely a hook member. It is to be understood by those skilled in the art that various changes can be made to the hook member, such as providing the member to be circular or include any shape or configuration for the hook. This member is designed solely to be an attaching means for enabling a user to attach the hook device to a desired object (i.e. clothing rod, a second hanger, etc.).

Figure 7A:
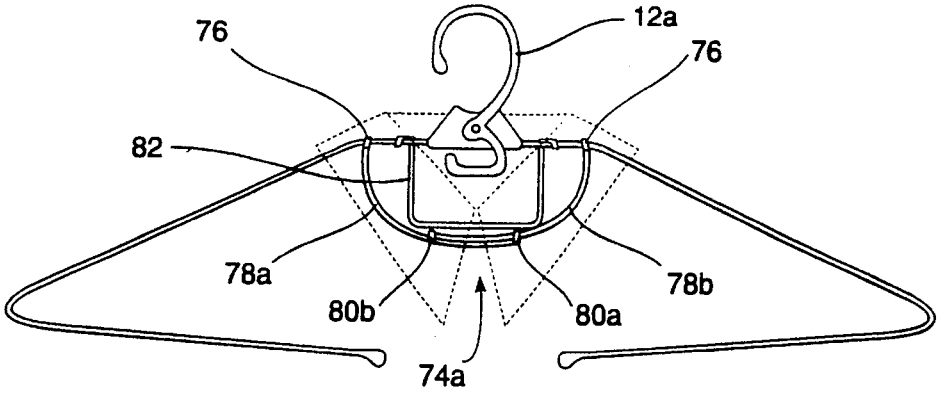
FIG. 7*a* is a front perspective view of the first embodiment of the collar attachment which can be used with the hanger device of the present invention.
Figure 7B:
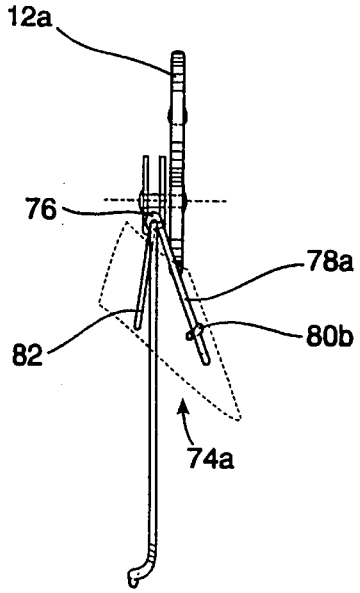
FIG. 7*b* is a side plan view of the first embodiment of the collar attachment which can be used with the hanger device of the present invention.

The above described embodiments, illustrated in FIGS. 1*a*–4, for the hanger device of the present invention, can also include a collar member that is adapted to be received in the collar of a conventional shirt, sweater, blouse, or the like. This collar member will aid in providing the conventional shirt to be maintained in a fixed and formed position. The first embodiment of the collar member 74*a* is illustrated in further detail in FIGS. 7*a* and 7*b*. As seen in these figures, the collar member includes a pair of spring members 76 which are located on opposite sides of the first hook member 12*a*. Extending frontwardly from the spring members 76 are collar supports 78*a* and 78*b*. Each end of the collar supports 78*a* and 78*b*, respectively are turned and looped to form a receiving means 80*a* and 80*b*. This will allow for the first collar support 78*a* to be received in the second receiving means 80*b* of the second collar support 78*b* and the second collar support 78*b* to be received in the first receiving means 80*a* of the first collar support 78*a*. This design and configuration, as seen in the drawings, will provide for each collar support to receive one another, inherently providing the first collar support 78*a* to slide into the second receiving means and the second collar support 78*b* to slide into the first receiving means. Accordingly enabling the diameter of the collar member to alter in size.

Extending downwardly from the spring members 76 is a holding device 82. This holding device will enable accessories or the like to be hung and maintained. Covering the spring members 76 and an upper portion of the holding device is a brace member (not illustrated). This brace member will retain the spring members 76 in a fixed position and will provide the collar supports 78*a* and 78*b* to extend outwardly from the hanger device. The brace will also permit for the holding device 82 to be in a fixed and secured downward position. Accordingly, providing the first and second collar supports 78*a* and 78*b*, respectively, to be adapted to contact and engage the collar of a garment for the upper body, such as a shirt, sweater, or the like.

The spring members 76, collar supports 78*a*, 78*b*, and holding device 82 are all fabricated from a single piece of material, such as wire, to provide for a unitary and unibody structure. The brace is adapted to located on the spring members and a portion of the collar supports and holding device for providing securment and support of the collar member 74*a* onto the hanger device.

Figure 8A:
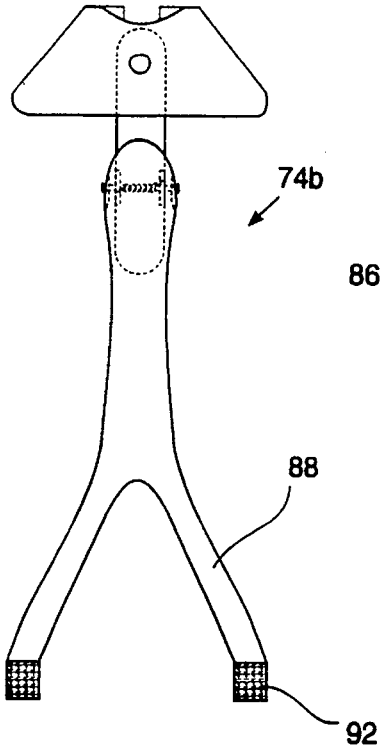
FIG. 8*a* is a second embodiment of the collar attachment which can be used with the hanger device of the present invention.
Figure 8B:
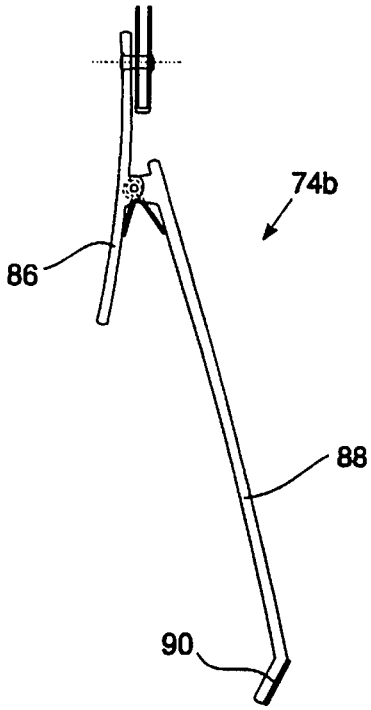
FIG. 8*b* is a side plan view of the second embodiment of the collar attachment which can be used with the hanger device of the present invention.

FIG. 8*a* and FIG. 8*b* illustrate a second embodiment for the collar member which can be utilized with any of the hangers illustrated in the above described embodiments.

As seen in these figures, the collar member 74*b* is adapted to be centrally secured to the shoulder supports. This will provide for the collar member 74*b* to extend downwardly from the shoulder supports. As seen in these figures, the collar member 74*b* includes a back portion 86 and a front portion 88. The back portion 86 is adapted to contact the back inner surface of the garment for the upper body.

The front portion 88 is adapted to support the collar on a convention shirt, sweater, or the like. As seen, this front portion is Y-shape and extends outwardly from the back portion. This will enable the collar member to evenly support the front of the collar on a conventional shirt or the like. As seen, the tips 90 can extend slightly inward from the front portion 88 and can also include friction pads 92 for aiding in the holding or securment of the shirt to the collar support. Hence, the tips 90 of the collar support **74*b*** will be adapted to contact the collar of a conventional garment for the upper body, in order to provide for the collar to be in a formed position.

While the invention has been particularly shown and described with reference to an embodiment thereof, it will be understood by those skilled in the art that various changes in form and detail may be made without departing form the spirit and scope of the invention.

I claim:

1. A garment hanger comprising:

an attaching means;

a pair of shoulder supports each including a top end and a side end, and each top end is secured to said attaching means; and a sleeve extender connected to each side end of said shoulder supports and said sleeve extenders each including a first end and a second end, said first ends curve backwardly from said side ends for providing said sleeve extenders to be disposed from said shoulder support on a separate plane and for a first gap to be located between said shoulder supports and said sleeve extenders; and said sleeve extenders extend downwardly from said first end to said second end and towards each other providing a second gap to be located between said second ends of said sleeve extenders.

2. A garment hanger as in claim 1 wherein said attaching means is a first hook member.

3. A garment hanger as in claim 2 wherein a double sided clip is secured below said first hook.

4. A garment hanger as in claim 3 wherein said double sided clip further includes a loop.

5. A garment hanger as in claim 1 wherein said first lower garment bar extension is pivotally located on said shoulder supports and extends downwardly from said shoulder support.

6. A garment hanger as in claim 5 wherein said first lower garment bar extension is C-shape and includes distal ends which are secured to said shoulder supports, said first lower garment bar extension further includes elbows which are aligned with said second ends of said sleeve extenders.

7. A garment hanger as in claim 5 wherein said first lower garment bar extension further includes a plurality of clips for maintaining garments for the lower body.

8. A garment hanger as in claim 5 wherein a second lower garment bar extension is pivotally secured to a lower portion of said first lower garment bar extension.

9. A garment hanger as in claim 5 futher comprising a plurality of additional garment bar extensions, wherein the succeeding garment bar extension is pivotally secured to a preceding garment bar extension.

10. A garment hanger as in claim 3, wherein a first lower garment bar extension is adapted to be removably secured to said double sided clip.

11. A garment hanger as in claim 10 wherein said first lower garment bar extension includes a first hook member adapted to be removably secured to said double sided clip, and a plurality of additional lower garment bar extensions are pivotally secured to an upper portion of said first lower garment bar extension.

12. A garment hanger as in claim 1 wherein an external body insert extension is adapted to be slidably inserted between said sleeve extenders and said shoulder support for use when a garment is secured thereto.

13. A garment hanger as in claim 12 wherein rods are slidably secured to each sleeve extender and a securing means is adapted to engage and secure said rods when said garment is secured thereto.

14. A garment hanger as in claim 12 wherein said external body extension includes a lower portion and an upper portion, said lower portion is pivotally secured to said upper portion and can be folded in an upward position.

15. A garment hanger as in claim 13 wherein said external body extension includes a lower portion and an upper portion, said lower portion is pivotally secured to said upper portion and can be folded in an upward position, and said rods are located within said upper portion.

16. A garment hanger as in claim 12 wherein said external body extension can be adjusted in length, width or length and width via an adjusting means.

17. A garment hanger as in claim 1 wherein a collar member is secured to said shoulder support for providing support to a collar of a garment.

18. A garment hanger as in claim 17 wherein said collar member is semi-circular and includes an adjusting means for adjusting an inner diameter of said collar member for enabling said collar member to accommodate any size or shape collar.

19. A garment hanger as in claim 17 wherein said collar support includes a Y-shape which extends centrally and downwardly from said shoulder supports, said collar support include a pair of tips ends having tips which are adapted to contact said collar.

20. A garment hanger as in claim 19 wherein said pair of tips extend inwardly.

* * * * *